US006681852B2

(12) United States Patent
Baskett et al.

(10) Patent No.: US 6,681,852 B2
(45) Date of Patent: Jan. 27, 2004

(54) TUBING HANGER SHUTTLE VALVE

(75) Inventors: David C. Baskett, Houston, TX (US); Bhailal Parmar, Sugar Land, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

(21) Appl. No.: 09/774,287

(22) Filed: Jan. 29, 2001

(65) Prior Publication Data

US 2002/0029887 A1 Mar. 14, 2002

Related U.S. Application Data

(60) Provisional application No. 60/178,845, filed on Jan. 27, 2000.

(51) Int. Cl.[7] ..... E21B 23/04

(52) U.S. Cl. ..... 166/208; 166/319; 166/332.5; 166/334.4

(58) Field of Search ..... 166/208, 212, 166/120, 187, 332.5, 334.1, 368, 382, 350, 360, 334.4, 319

(56) References Cited

U.S. PATENT DOCUMENTS

| | | | | |
|---|---|---|---|---|
| 3,279,536 A | | 10/1966 | Wakefield, Jr. | |
| 3,662,822 A | | 5/1972 | Wakefield, Jr. | |
| 3,860,069 A | * | 1/1975 | Wray et al. | 166/264 |
| 4,133,378 A | | 1/1979 | Gano | 166/85 |
| 4,154,298 A | | 5/1979 | Gano | 166/85 |
| 4,432,417 A | * | 2/1984 | Bowyer | 166/120 |
| 4,846,272 A | * | 7/1989 | Leggett | 166/126 |
| 4,886,121 A | | 12/1989 | Demmy et al. | 166/382 |
| 5,044,432 A | * | 9/1991 | Cunningham et al. | 166/319 |
| 5,372,199 A | | 12/1994 | Cegielski et al. | 166/368 |
| 5,544,707 A | | 8/1996 | Hopper et al. | 166/382 |
| 5,988,282 A | | 11/1999 | Cuiper et al. | 166/348 |
| 6,062,314 A | | 5/2000 | Nobileau | 166/368 |

FOREIGN PATENT DOCUMENTS

| | | |
|---|---|---|
| GB | 2166775 A | 5/1986 |
| GB | 2192921 A | 1/1988 |
| WO | WO 86/01852 | 5/1986 |

OTHER PUBLICATIONS

SPE 23050, *Electrical Submersible Pumps in Subsea Completions*, P.A. Scott, M. Bowring and B. Coleman, 1991.
*Electric Submersible Pump for Subsea Completed Wells*, Sigbjorn Sangesland, Nordic Counsel of Ministers Program for Petroleum Technology, Nov. 26–27, 1991.
*A Simplified Subsea System Design*, Sigbjorn Sangesland, Underwater Technology Conference, Bergen 1990.
*Simplified Subsea System Design*, Sigbjorn Sangesland, Subsea Production Technology, CE–Course, Oct. 23–27 and Nov. 20–24, 1989.

(List continued on next page.)

*Primary Examiner*—Zakiya Walker
(74) *Attorney, Agent, or Firm*—Howrey Simon Arnold & White, LLP

(57) ABSTRACT

A tubing hanger to facilitate production tubing annulus access including a tubing hanger body having a central bore, a shuttle valve slidably mounted to the tubing hanger body, and at least one annulus access bore through the tubing hanger permitting fluid communication between the central bore and an annulus defined between a production tubing string and a wellbore or casing via the tubing hanger body and the shuttle valve. The shuttle valve may be slidingly movable between an open and a closed position. The tubing hanger may further include a groove enclosed by a filler, the groove providing communication between a plurality of small annulus access bores and a large annulus access bore.

23 Claims, 10 Drawing Sheets

OTHER PUBLICATIONS

*A Simplified Subsea System Design*, Sigbjorn Sangesland, Presented at Underwater Technology Conference in Bergen, Mar. 19–21, 1990.

*Declaration of David Lorimer* (*and attachments dated 1991*), David Lorimer, Submitted in Civil Action No. H–97–0155 (Cooper Cameron Corp. v. Kvaerner Oilfield Prods, Inc.), Jul. 10, 2002.

*Subsea Submersible Pumping Project Task Series 1000 Equipment Evaluations*, Vetco Gray (undated).

*First Interim Report—Technical*, Subsea Intervention Systems, Ltd., Project No. TH/03328/89, Jan. 1991.

*Subsea Submersible Pumping Project Task No. 2000 Conceptual Design Report*, Jan., 1991.

*Second Interim Report—Technical*, Subsea Intervention Systems, Ltd., Project No. TH/03328/89, Jun. 1991.

*Third Interim Report—Technical*, Subsea Intervention Systems, Ltd., Project No. TH/03328/89, Dec. 1991.

*Subsea Submersible Pumping Project, Final Report vol. 1*, Subsea Intervention Systems, Ltd., Task Nos. 3000 and 4000, Mar. 1992.

*Subsea Submersible Pumping Project, Final Report vol. 2*, Subsea Intervention Systems, Ltd., Task Nos. 3000 and 4000, Mar. 1992.

*Subsea Submersible Pumping Project, Final Report vol. 3*, Subsea Intervention Systems, Ltd., Task Nos. 3000 and 4000, Mar. 1992.

*Through Bore Tree System*, Ref: TSD 6302, National Oilwell (UK) Limited, Jan. 1993.

*Declaration of Sigbjorn Sangesland and Attachments*, Sigbjorn Sangesland, Submitted in Civil Action No. H–97–0155 (Cooper Cameron Corp. v. Kvaerner Oilfield Prods, Inc.), Undated.

* cited by examiner

TUBING HANGER SHUTTLE VALVE

This application claims the benefit of U.S. Provisional Application No. 60/178,845, filed Jan. 27, 2000, the specification of which is incorporated herein by reference.

FIELD OF THE INVENTION

This invention relates generally to subsea oil and gas production methods and apparatus and, more particularly, to a tubing hanger valve design for facilitating annulus access in a subsea wellhead and Christmas tree system.

SUMMARY OF THE INVENTION

There is disclosed in one embodiment a tubing hanger and shuttle valve, the shuttle valve including: a body; a first radial bore through the body; a first tubing with a sealing face arranged adjacent and substantially perpendicular to the body, wherein the first tubing is slidingly positionable; and wherein the first tubing defines a first passageway facilitating fluid communication with a first bore in the tubing hanger. According to this embodiment the body may include first and second cylindrical portions, the first cylindrical portion having a larger diameter than the second cylindrical portion. The first and second cylindrical portions may each include a seal arranged about the body.

In one embodiment of the tubing hanger and shuttle valve, the body includes a first flat machined face at the first bore.

In one embodiment the first bore through the body includes an annulus access bore for providing fluid communication between the tubing hanger and an annulus defined by the tubing hanger and a wellbore or casing.

In one embodiment the first bore in the tubing hanger is arranged substantially longitudinally through the interior of the tubing hanger.

In one embodiment of the disclosed tubing hanger and shuttle valve there is a first spacer with a plurality of holes disposed therein, the first spacer being attached between the first tubing and the first bore in the tubing hanger.

Some embodiments include a second radial bore through the body. The second radial bore through the body may include a chemical injection access bore for providing fluid communication between the tubing hanger and a wellbore. The body may further include a second flat machined face at the second radial bore. The valve may include a second tubing with a sealing face arranged adjacent and substantially perpendicular to the body, wherein the second tubing is slidingly positionable and wherein the second tubing defines a second passageway facilitating fluid communication with a second bore in the tubing hanger. The second bore in the tubing hanger may be arranged substantially longitudinally through the interior of the tubing hanger.

Some embodiments include a second spacer with a plurality of holes disposed therein, the second spacer being attached between the second tubing and the second bore in the tubing hanger.

In one embodiment the first tubing and first radial bore are not aligned and the first tubing is sealed off from the first radial bore in the first position by the sealing face. In addition, inasmuch as there is sometimes a second tubing and second radial bore, the second tubing and second radial bore are not aligned and the second tubing is sealed off from the second radial bore in the first position by the sealing face. However, the first tubing and first radial bore are aligned in the second position, and likewise the second tubing and second radial bore are aligned in the second position. The first and second positions may be changed by the application of hydraulic pressure communicated between first shoulders in the body and the tubing hanger. The first and second positions may also be changed by the insertion of a valve stab abutting an interior shoulder of the shuttle valve body.

In one embodiment there is disclosed a subsea apparatus including: a tubing hanger; a shuttle valve disposed within the tubing hanger, the shuttle valve comprising: a body; first and second radial bores through the body; first and second tubings with sealing faces arranged adjacent and substantially perpendicular to the body, wherein the first and second tubings are slidingly positionable; and wherein the first and second tubings define first and second passageways facilitating fluid communication with first and second bores in the tubing hanger. This embodiment may further include a first spacer with at least one hole, the first spacer being arranged between the first tubing and the first bore in the tubing hanger; and there may also be included a second spacer with at least one hole, the second spacer being arranged between the second tubing and the second bore in the tubing hanger.

In one embodiment there is disclosed a tubing hanger to facilitate production tubing annulus access including: a tubing hanger body having a central bore; a shuttle valve slidably mounted to the tubing hanger body; and at least one annulus access bore through the tubing hanger permitting fluid communication between the central bore and an annulus defined between a production tubing string and a wellbore or casing via the tubing hanger body and the shuttle valve. In this embodiment the shuttle valve may be slidingly movable between an open and a closed position. The tubing hanger may further include a groove enclosed by a filler, the groove providing communication between a plurality of small annulus access bores and a large annulus access bore.

BRIEF DESCRIPTION OF THE DRAWINGS

The foregoing and other features and aspects of the invention will become further apparent upon reading the following detailed description and upon reference to the drawings in which.

Figure 1:
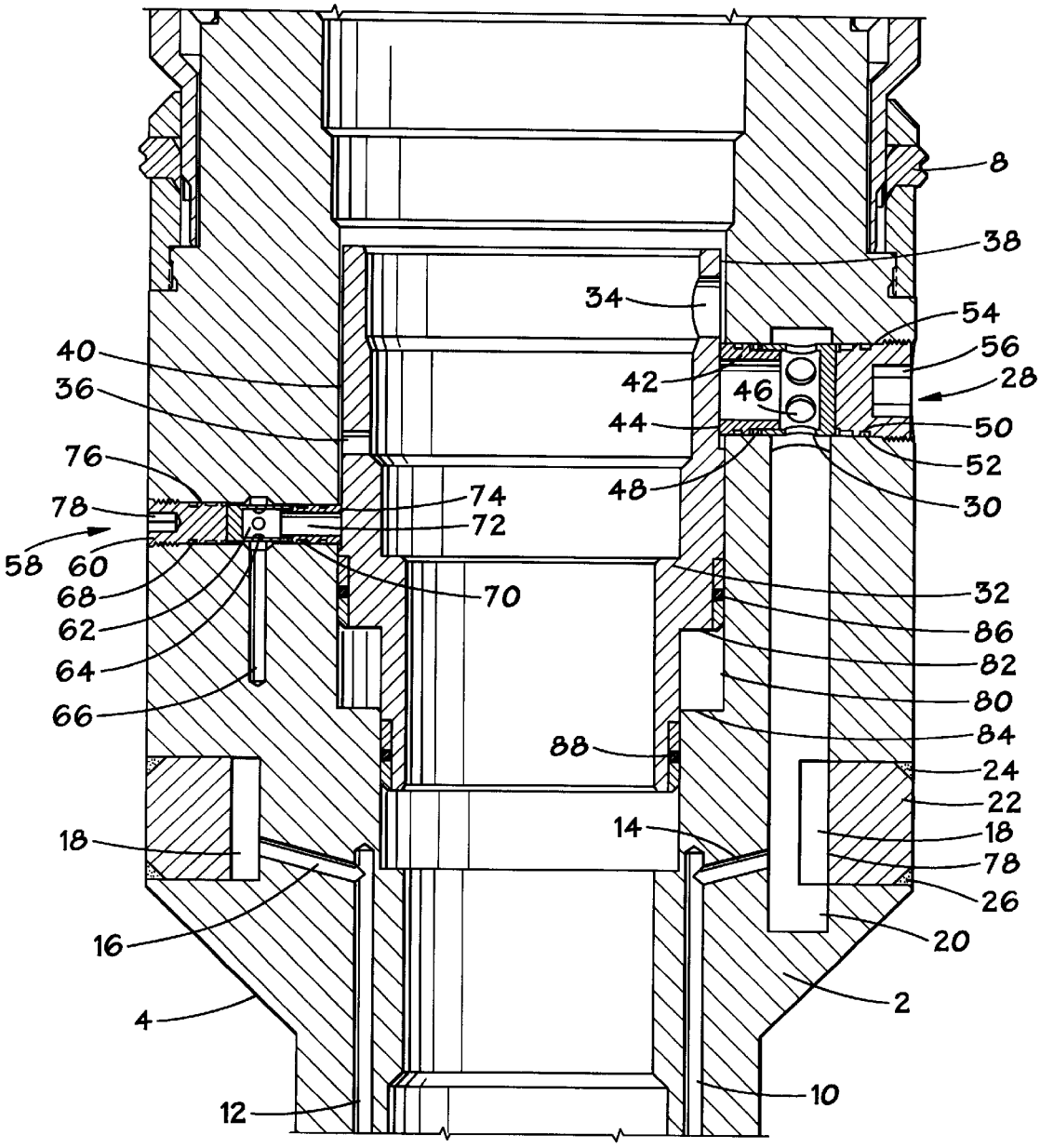
FIG. 1 depicts a tubing hanger design in accordance with one aspect of the invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Turning now to the Figures, and in particular FIG. 1, one embodiment of a tubing hanger 2 for installation in a wellhead is shown. Tubing hanger 2 is designed to facilitate both chemical injection and isolation of annulus pressure from a production stream but may have multiple injection lines, or other connections downhole. Tubing hanger 2 may be installed substantially concentrically within a wellhead or, in alternate embodiments, in a Christmas tree (not shown). Tubing hanger 2 is preferably a concentric tubing hanger, 7 inches in diameter, but may be eccentric and/or range in size as required for a particular field development. Tubing hanger 2 includes a shoulder 4 which may rest on a mating shoulder in the wellhead (Not shown). A tubing hanger lock down apparatus 8 at the proximal end of tubing hanger 2 may be used to secure the tubing hanger within an installed wellhead or tree (not shown). The lower end of tubing hanger 2 may suspend a downhole tubing (not shown) to facilitate a production flow from wellbore to surface when a downhole safety valve (not shown) is open.

Referring to FIG. 1, disposed within tubing hanger 2 are a plurality of bores, including bores 10 and 12, which extend distally to the annulus between the production tubing and the wellbore or casing (not shown) at one end, and meet lateral bores 14 and 16, respectively, at the opposite ends. Lateral bores 14 and 16 communicate with a machined groove 18 which extends continuously along a circumferential path around tubing hanger 2. Machined groove 18 provides a fluid communication path between lateral bore 16 and a large annulus access bore 20. Large annulus access bore 20 is also in fluid communication with lateral bore 14. Thus, bores 10 and 12 are in fluid communication with large annulus access bore 20 via lateral bores 14 and 16 and machined groove 18. Machined groove 18 facilitates increased fluid flow into and out of bores 10 and 12. A filler material 22, which may be the same type of material comprising tubing hanger 2 encloses machined groove 18. Welds 24 and 26 weld the filler material to tubing hanger 2 and prevent any leaks from machined groove 18.

Continuing with FIG. 1, large annulus access bore 20 extends proximally from machined groove 18 to meet a shuttle valve assembly 28. In the embodiment shown in FIG. 1, large annulus access bore 20 meets a spacer 30 of valve assembly 28. Valve assembly 28 may include a body 32 with opposing bores 34 and 36. In the embodiment of FIG. 1, bore 34 is an annulus access bore and will be referred to as such hereafter. Bore 36 is shown in the embodiment of FIG. 1 as a chemical injection bore. Body 32 of valve assembly 28 may exhibit flat machined faces 38 and 40 on the outer diameter of the body at bores 34 and 36. Machined face 38 may be seen more clearly in FIGS. 3A and 3B, and machined face 40 is similar but not shown in FIGS. 3A and 3B. A tubing 42 with a sealing face 44 meets flat machined face 38. Tubing 42 is attached to spacer 30 and is in fluid communication with large annulus access bore 20 via a plurality of holes 46 arranged about the circumference of the spacer. A plurality of seals 48 seal between tubing hangar 2 and tubing 42.

Adjacent to spacer 30 opposite the connection to tubing 42 is an adjustable plug 50. A plurality of seals 52 on adjustable plug 50 inhibits leakage past the plug. Adjustable plug 50, spacer 30, and tubing 42 are arranged within a radial bore 54 in tubing hanger 2. Adjustable plug 50 may have a hex recess 56 to allow an operator to adjust the compression between machined face 38 and sealing face 44.

As shown in the figures, valve assembly 28 may include a chemical injection assembly 58. Chemical injection assembly 58 includes a chemical injection adjustable plug 60 adjacent a chemical injection spacer 62. Chemical injection spacer 62 includes a plurality of holes 64 to facilitate fluid communication with a chemical injection bore 66 in tubing hanger 2. Chemical injection adjustable plug 60 includes a plurality of seals 68 to inhibit leakage past the plug. Chemical injection spacer 62 attaches to chemical injection tubing 72. Chemical injection tubing 72 includes a sealing face 74 which meets flat machined surface 40. Chemical injection adjustable plug 60, spacer 62, and tubing 72 are arranged within a second radial bore 76 in tubing hanger 2. Chemical injection adjustable plug 60 may have a hex recess 78 to allow an operator to adjust the compression between machined face 40 on and sealing face 74. Another plurality of seals 70 inhibits any leakage of fluids to the central bore of tubing hangar 2 across the annular space between tubing 72 and the radial bore 76.

As shown in FIG. 1, shuttle valve assembly 28 is in a first or closed position. A first set of seals 86 and a second set of seals 88 inhibit fluid leakage between body 32 of valve assembly 28 and the internal diameter of tubing hanger 2. Seals 86 and 88 are arranged in different planes from one another as the body 32 may include a diameter-reducing "step" at shoulder 82. Each of first and second seals 86 and 88 may comprise a primary metal-to-metal seal and secondary elastomer or polymer seal, with retainers in between. In the first position (shown in FIG. 1), annulus access bore 34 is not aligned with annulus access tubing 42. Likewise, chemical injection bore 36 is not aligned with chemical injection tubing 72. A gap 80 between a valve body shoulder 82 and an associated tubing hanger shoulder 84 exists in this open valve position. In some embodiments, one or both of annulus access bore 34 and chemical injection bore 36 lined up with its associated tubing (42 and 72) in the first position.

Figure 2:
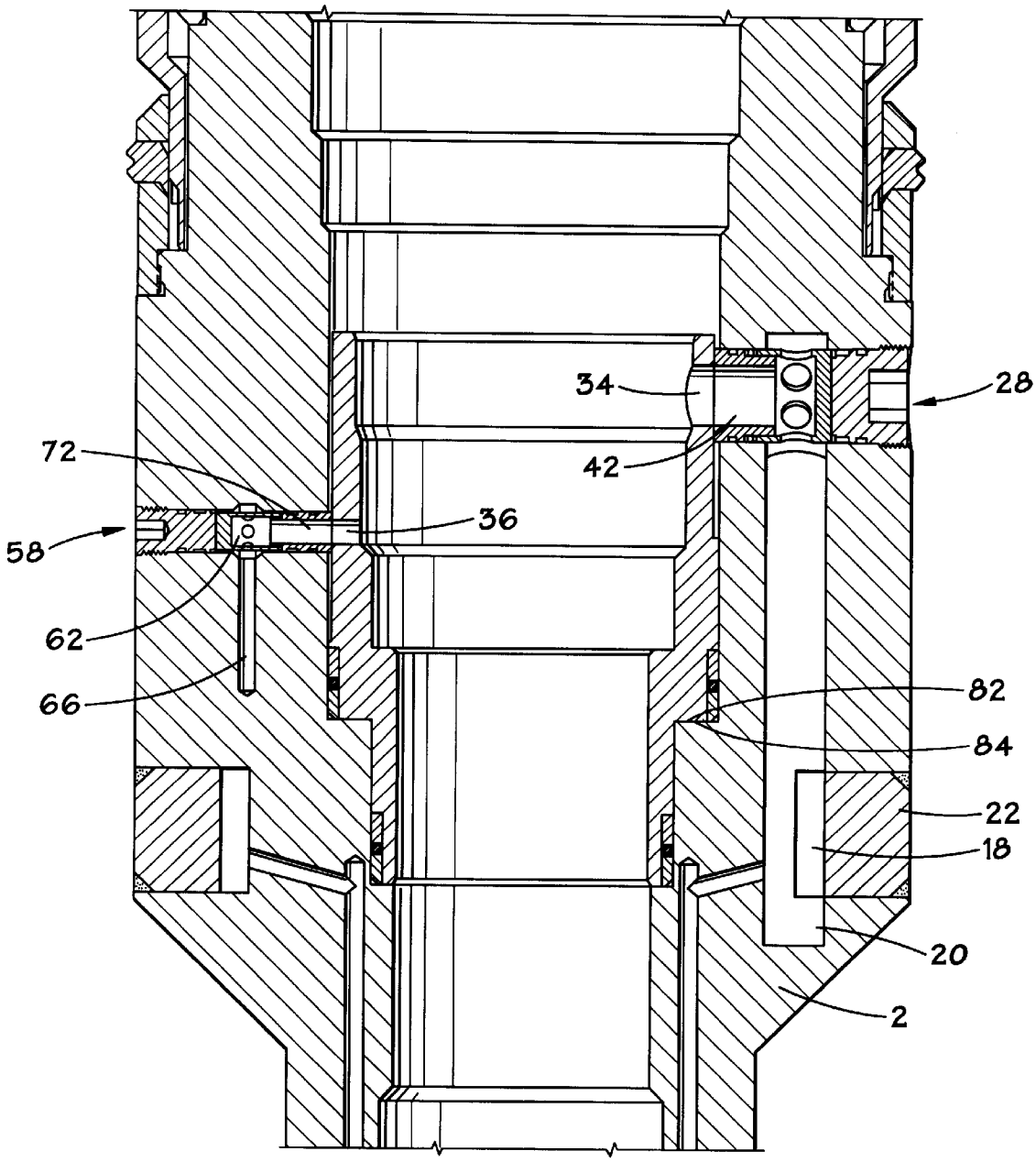
FIG. 2 depicts the tubing hanger design according to FIG. 1 in a second position.

Referring now to FIG. 2, shuttle valve assembly 28 is shown in a second or open position. With the shuttle valve assembly open, gap 80 has been reduced as valve body shoulder 82 abuts tubing hanger shoulder 84. Annulus access bore 34 is aligned with annulus access tubing 42, providing for fluid communication between the surface and the production tubing annulus. Likewise, chemical injection bore 36 is aligned with chemical injection tubing 72 to allow fluid communication between the chemical injection line and the downhole annulus or wellbore.

Figure 3A:
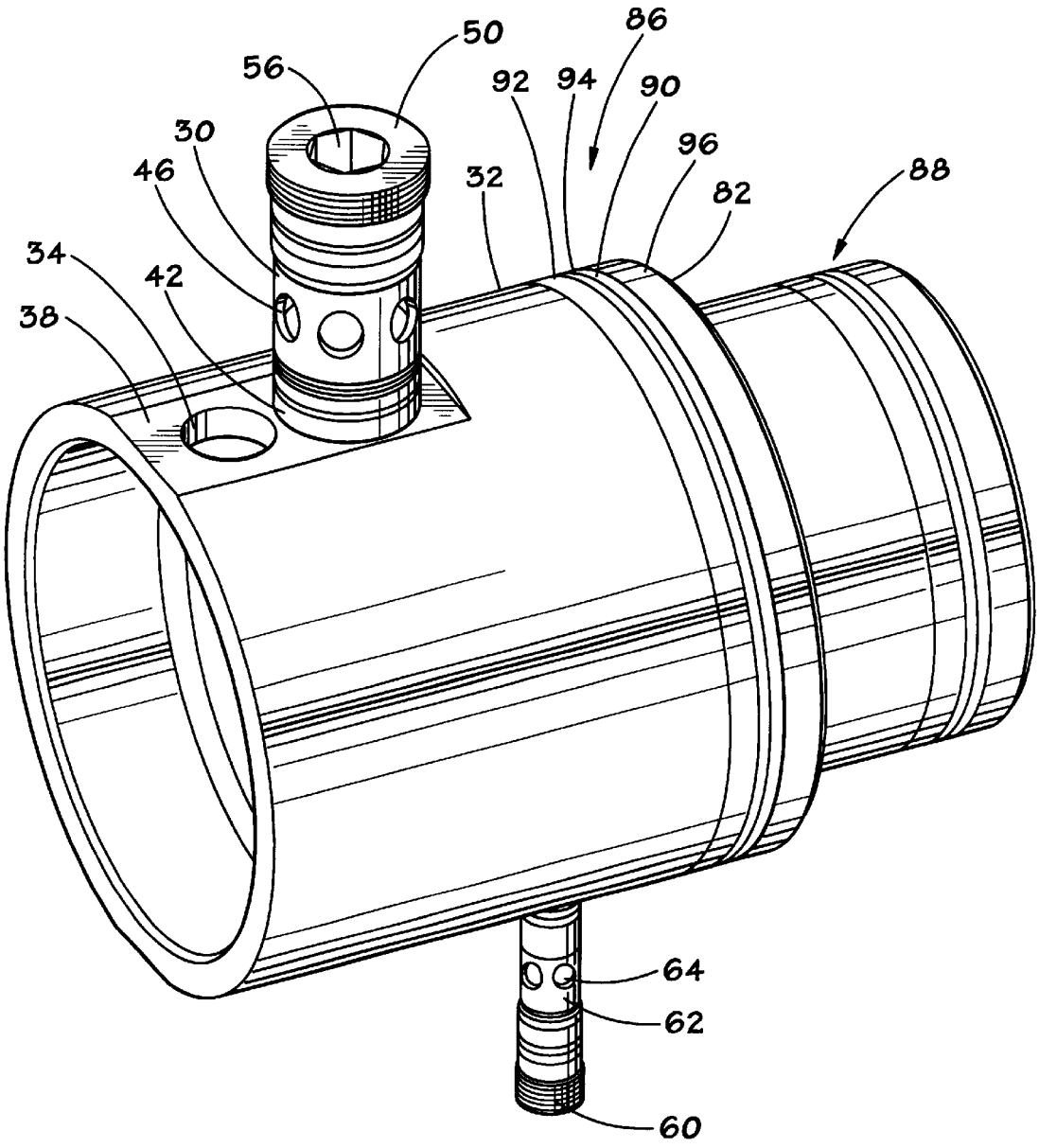
FIGS. 3A and 3B depict perspective views of the tubing hanger valve assembly according to the design shown in FIG. 1.
Figure 3B:
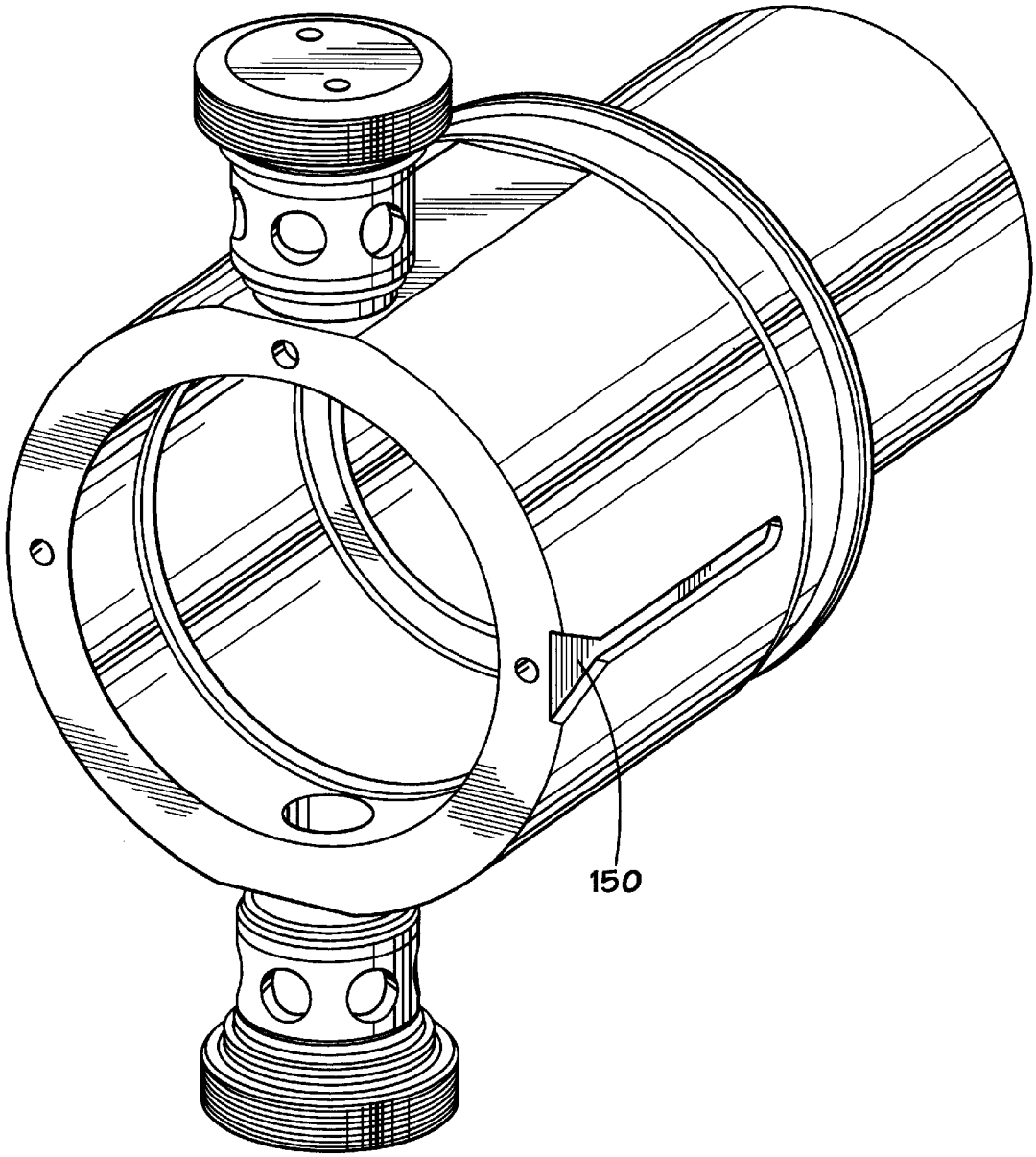

Referring next to FIGS. 3A and 3B, the shuttle valve assembly is shown in perspective views. FIG. 3A view is shown in the first or closed position. In this view flat face 38 in valve body 32 may be clearly seen, and a similar flat face 40 occurs adjacent chemical injection tubing 72. Valve body 32 may exhibit the change in diameter at shoulder 82 as shown to facilitate first and second positions. Seals 86 and 88 may also be seen with primary metal seal 90 and secondary elastomer or polymer seal 92. Retainers 94 and 96 hold the seals in place. FIG. 3B shows the shuttle valve assembly in the second or open position. An orienting profile 150 is shown disposed in the valve body 32.

Figure 4A:
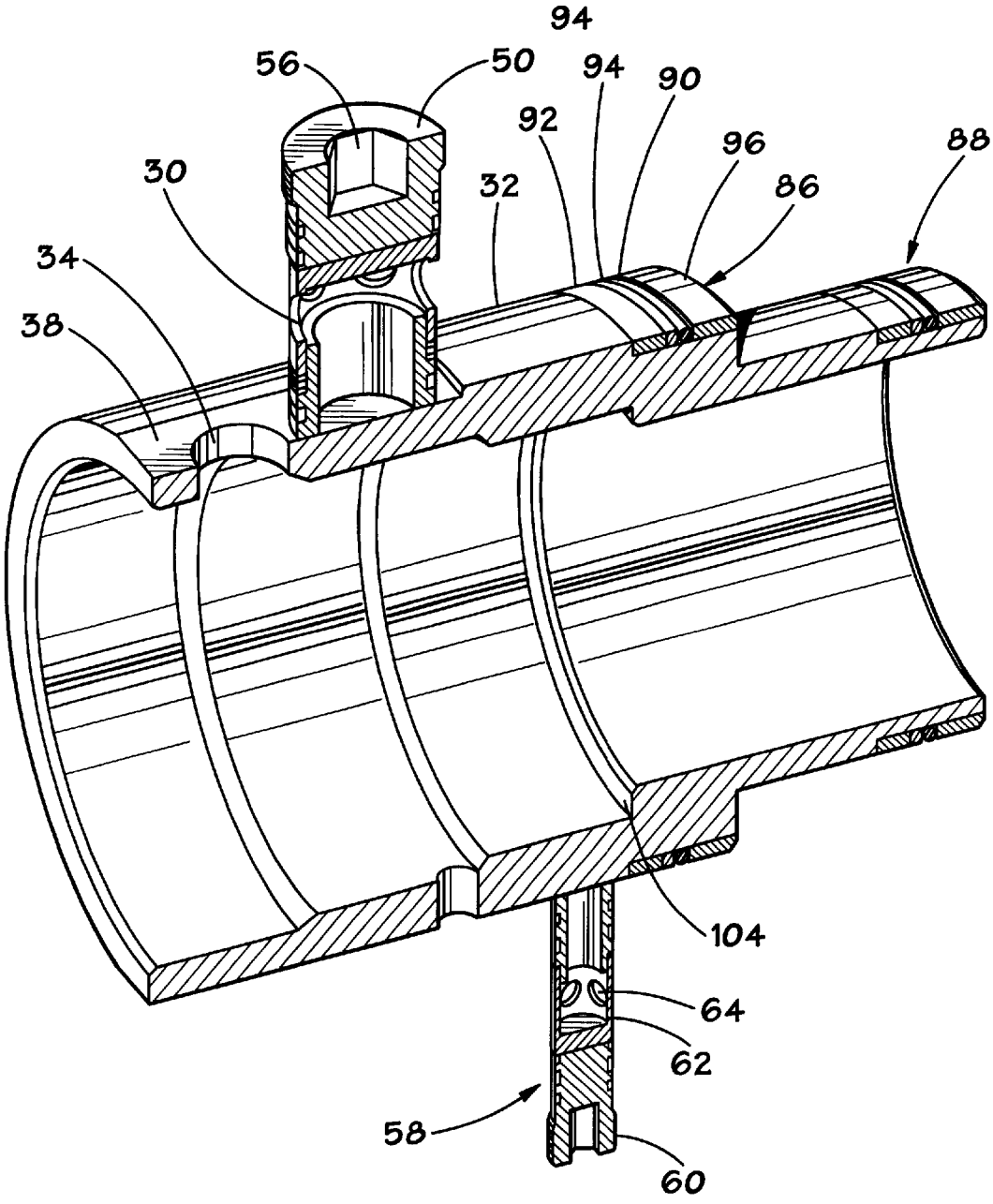
FIGS. 4A and 4B depict perspective views with a cutaway section of the tubing hanger valve assembly according to FIGS. 3A and 3B.
Figure 4B:
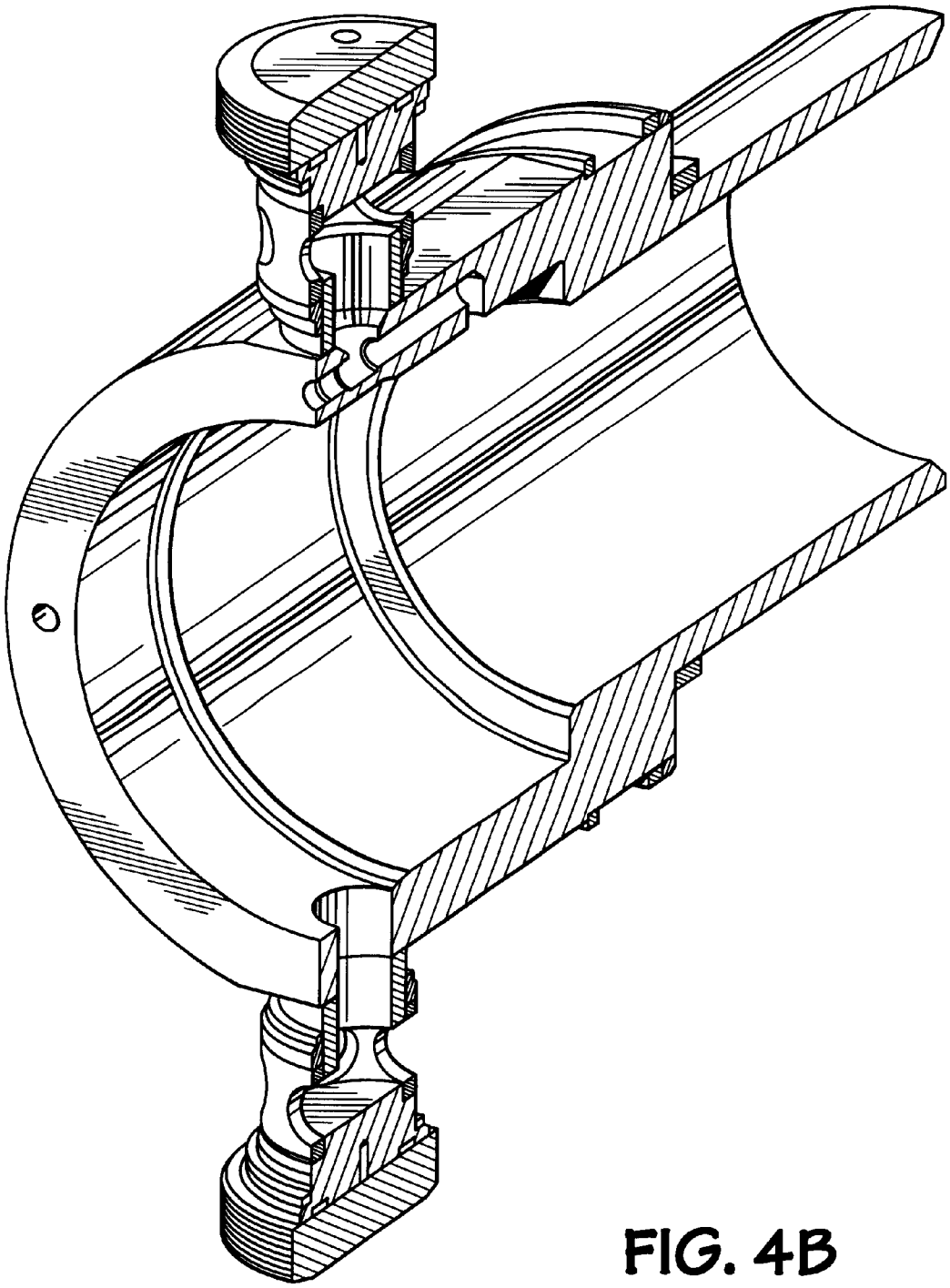

FIGS. 4A and 4B show cross-sectional views of shuttle valve assembly 28 as shown in FIGS. 3A and 3B.

Figure 5:
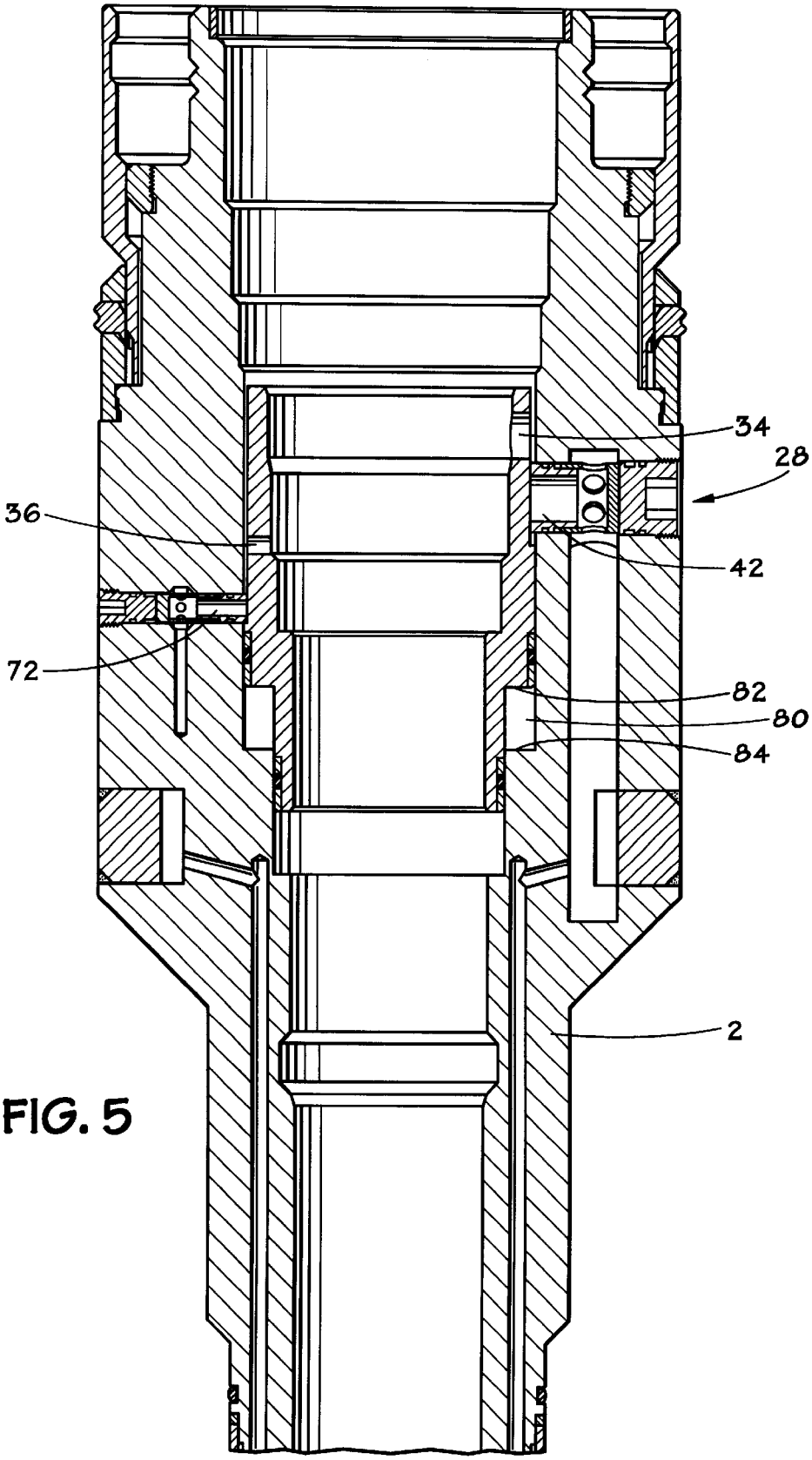
FIG. 5 depicts a cross sectional view of the tubing hanger design according to FIG. 1.

Referring next to FIG. 5, a cross-sectional view of the tubing hanger assembly 2 is shown. Shuttle valve assembly 28 is in the first or closed position in FIG. 5 with gap 80 between valve body shoulder 82 and tubing hanger shoulder 84. In this position annulus access bore 34 is not aligned with annulus access tubing 42. Likewise, chemical injection bore 36 is not aligned with chemical injection tubing 72.

Figure 6:
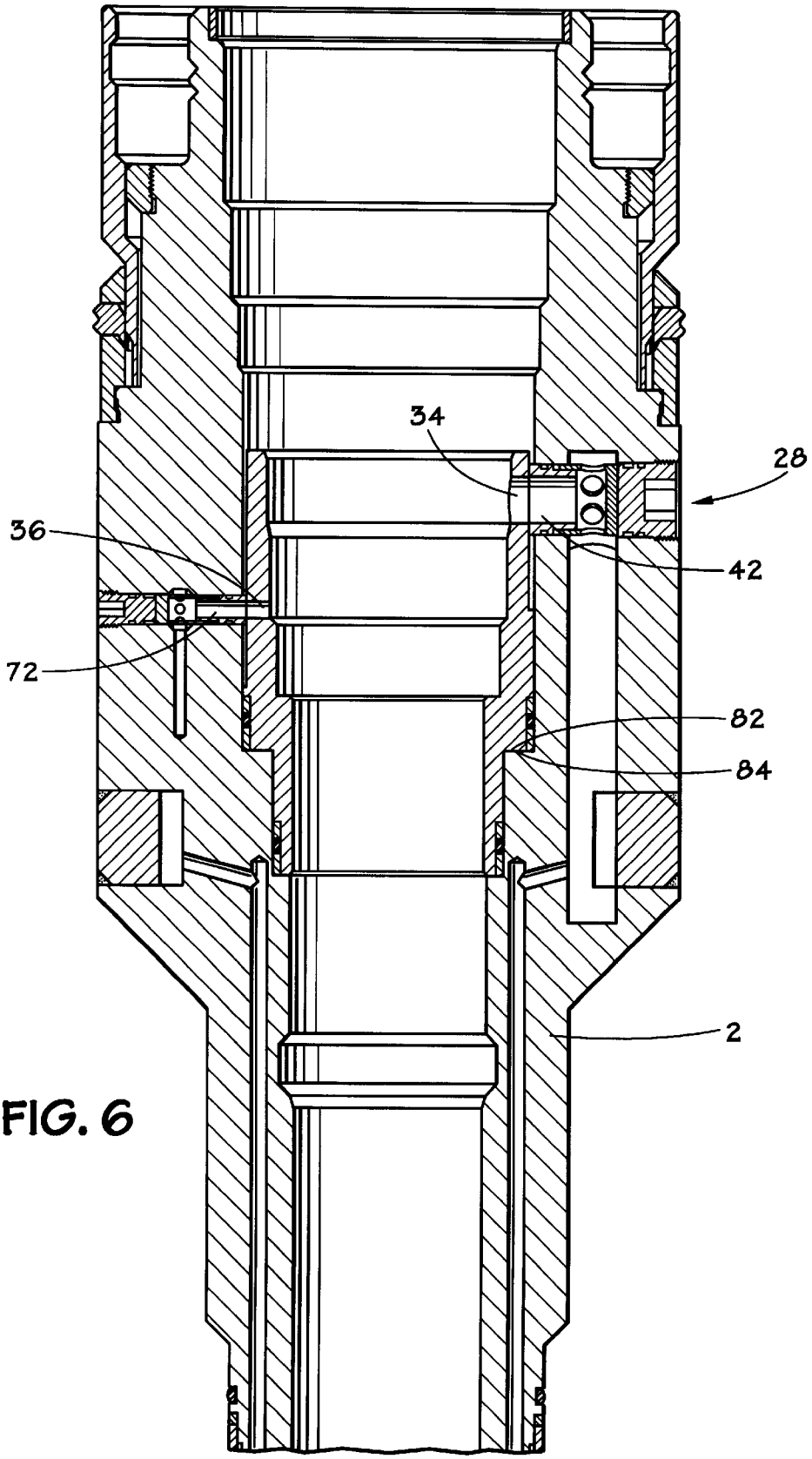
FIG. 6 depicts a cross sectional view of the tubing hanger design according to FIG. 5 in a second position.

Referring next to FIG. 6, a cross-sectional view of the tubing hanger assembly 2 is shown. Shuttle valve assembly 28 is in the second or open position in FIG. 5, with valve body shoulder 82 abutting tubing hanger shoulder 84. In this position annulus access bore 34 is aligned with annulus access tubing 42, providing for fluid communication between the surface and the production tubing annulus. Likewise, chemical injection bore 36 is aligned with chemical injection tubing 72 to allow fluid communication between the a chemical source and the well.

Figure 7:
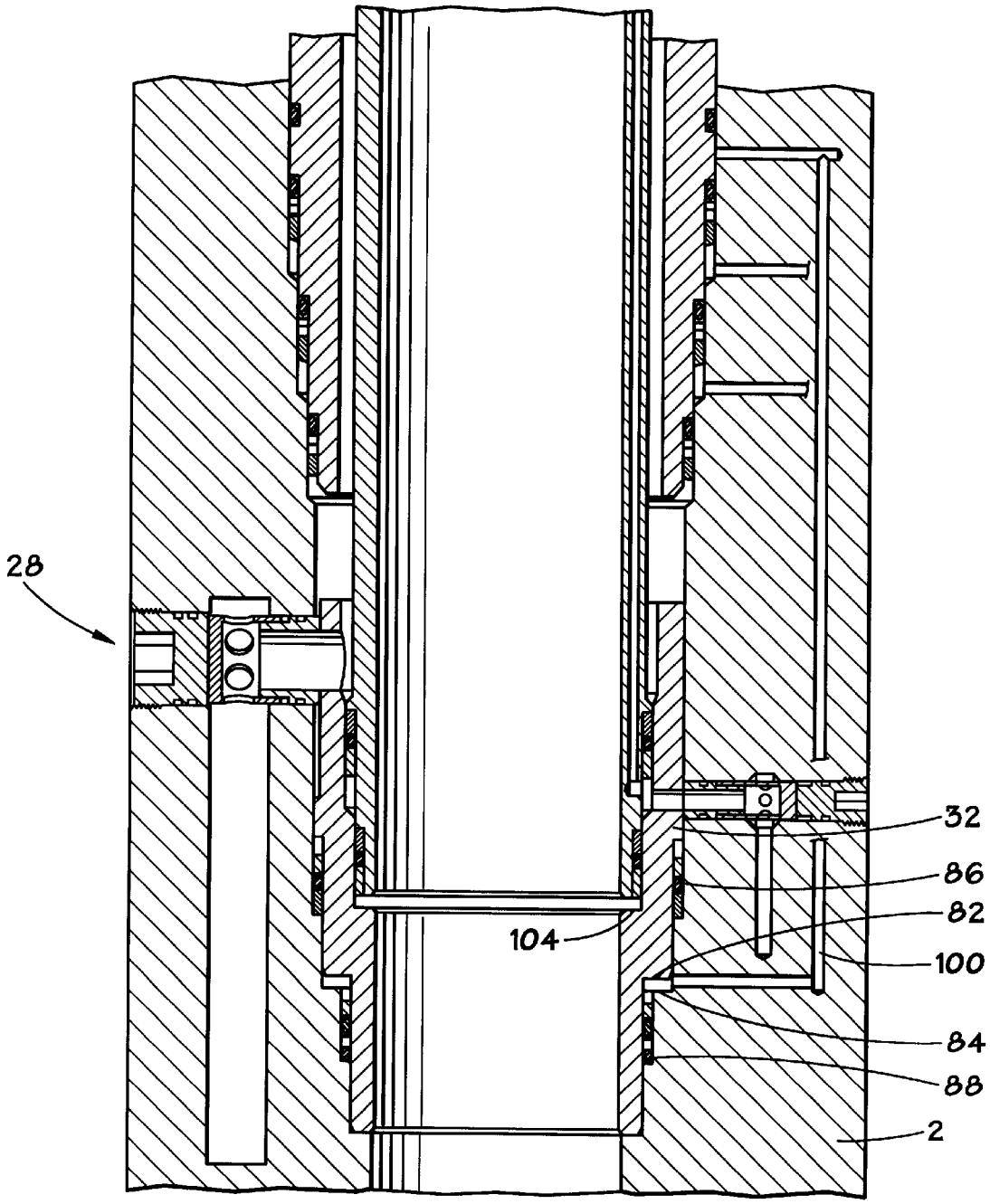
FIG. 7 depicts a cross section view of the tubing hanger including the valve actuating means in accordance with one aspect of the invention.

Referring next to FIG. 7, a cross sectional view of tubing hanger apparatus 2 showing the shuttle valve actuating means in accordance with one embodiment of the present invention is disclosed. When tubing hanger assembly 2 is run in, shuttle valve assembly 28 is in the open position shown in FIG. 2. Referring to FIG. 7, a hydraulic bore 100 which extends from the surface (not shown) to gap 80 between valve body shoulder 82 and tubing hanger shoulder 84 facilitates the actuation between first and second shuttle valve positions. When an operator needs access to either the production tubing annulus or desires to perform a chemical injection, fluid may be pumped through hydraulic bore 100 and into gap 80 to force valve body 32 into the second position. A predetermined hydraulic pressure on valve body shoulder 82 from hydraulic bore 100 will overcome the frictional forces between valve body 32 and the inner diameter of tubing hanger 2 caused by seals 86 and 88. When an operator desires to change shuttle valve assembly from the second position to the first position, a shuttle valve stab 102 may be inserted into the interior bore of shuttle valve body 32. Shuttle valve stab 102 meets an interior shoulder 104 arranged around the interior diameter of shuttle valve body 32. This interior shoulder may also be seen in FIG. 4A. A predetermined force on interior shoulder 104 transmitted by shuttle valve stab 102 will force the shuttle valve body 32 to return to the open position.

Figure 8:
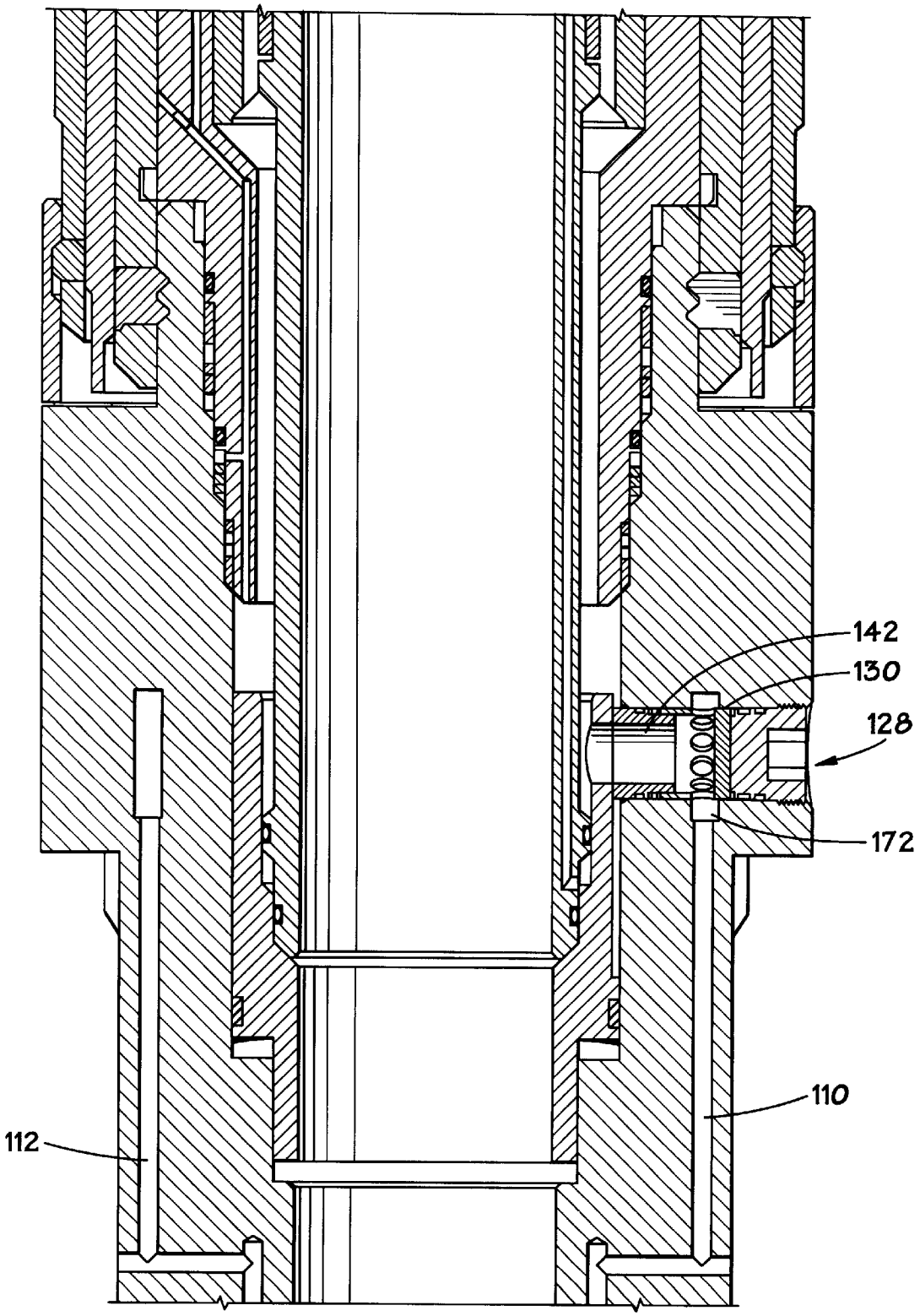
FIG. 8 depicts a tubing hanger design in accordance with another aspect of the invention.

Referring to FIG. 8, a second embodiment of the tubing hanger assembly is shown. In the embodiment shown in FIG. 8, annulus access bores 110 and 112 are substantially constant in diameter, as opposed to the embodiment shown in FIG. 1 in which large annulus bore 20 has a substantially larger diameter than bores 10 and 12. Annulus access bores 110 and 112 extend to a machined groove 172 which facilitates fluid communication with tubing 142 via spacer 130. The shuttle valve assembly 128 operates in the same manner in this embodiment as previously described.

While the present invention has been particularly shown and described with reference to particular illustrative embodiments thereof, it will be understood by those skilled in the art that various changes in form and details may be made without departing from the spirit and scope of the invention. The above-described embodiment is intended to be merely illustrative, and should not be considered as limiting the scope of the present invention.

What is claimed is:

1. A tubing hanger and shuttle valve, the shuttle valve comprising:

a) a body;

b) a first radial bore through the body;

c) a first tubing with a sealing face arranged adjacent and substantially perpendicular to the body; and wherein the first tubing defines a first passageway facilitating fluid communication with a first bore in the tubing hanger.

2. The tubing hanger and shuttle valve of claim 1 wherein the body comprises first and second cylindrical portions.

3. The tubing hanger and shuttle valve of claim 2 wherein the body further comprises a first flat machined face at the first bore.

4. The tubing hanger and shuttle valve of claim 2 wherein the first and second cylindrical portions each comprise a seal arranged about the body.

5. The tubing hanger and shuttle valve of claim 1 wherein the first bore through the body comprises an annulus access bore for providing fluid communication between the tubing hanger and an annulus defined by the tubing hanger and a wellbore or casing.

6. The tubing hanger and shuttle valve of claim 1 wherein the first bore in the tubing hanger is arranged substantially longitudinally through the interior of the tubing hanger.

7. The tubing hanger and shuttle valve of claim 1 further comprising a first spacer with a plurality of holes disposed therein, the first spacer attached between the first tubing and the first bore in the tubing hanger.

8. The tubing hanger and shuttle valve of claim 1 further comprising a second radial bore through the body.

9. The tubing hanger and shuttle valve of claim 8 wherein the second radial bore through the body comprises a chemical injection access bore for providing fluid communication between the tubing hanger a wellbore.

10. The tubing hanger and shuttle valve of claim 8 wherein the body further comprises a second flat machined face at the second radial bore.

11. The tubing hanger and shuttle valve of claim 8 further comprising a second tubing with a sealing face arranged adjacent and substantially perpendicular to the body, wherein the second tubing defines a second passageway facilitating fluid communication with a second bore in the tubing hanger.

12. The tubing hanger and shuttle valve of claim 11 wherein the second bore in the tubing hanger is arranged substantially longitudinally through the interior of the tubing hanger.

13. The tubing hanger and shuttle valve of claim 11 further comprising a second spacer with a plurality of holes disposed therein, the second spacer attached between the second tubing and the second bore in the tubing hanger.

14. The tubing hanger and shuttle valve of claim 11 wherein the second tubing and second radial bore are not aligned and the second tubing is sealed off from the second radial bore in the first position by the sealing face.

15. The tubing hanger and shuttle valve of claim 11 wherein the first tubing and first radial bore are aligned in the second position.

16. The tubing hanger and shuttle valve of claim 11 wherein the second tubing and second radial bore are aligned in the second position.

17. The tubing hanger and shuttle valve of claim 1 wherein the first tubing and first radial bore are not aligned and the first tubing is sealed off from the first radial bore in the first position by the sealing face.

18. The tubing hanger and shuttle valve of claim 1 wherein the body is moved from one position to the other position by the application of hydraulic pressure communicated between first shoulders in the body and the tubing hanger.

19. The tubing hanger and shuttle valve of claim 18 wherein the body is moved from one position to the other position by the insertion of a valve stab abutting an interior shoulder of the shuttle valve body.

20. A subsea apparatus comprising:

a) a tubing hanger;

b) a shuttle valve disposed within the tubing hanger, the shuttle valve comprising:

a body;

first and second radial bores through the body;

first and second tubings with sealing faces arranged adjacent and substantially perpendicular to the body, wherein the first and second tubings define first and second passageways facilitating fluid communication with first and second bores in the tubing hanger.

21. The apparatus of claim 20 further comprising a first spacer with at least one hole, the first spacer being arranged between the first tubing and the first bore in the tubing hanger; and a second spacer with at least one hole, the second spacer being arranged between the second tubing and the second bore in the tubing hanger.

22. The apparatus of claim 21 wherein the first and second bores in the tubing hanger extend substantially longitudinally through the tubing hanger.

23. A subsea tubing hanger to facilitate production tubing annulus access comprising:

a) a tubing hanger body having a central bore;

b) a shuttle valve slidably mounted to the tubing hanger body, c) at least one annulus access bore through the tubing hanger permitting fluid communication between the central bore and an annulus defined between a production tubing string and a wellbore or casing via the tubing hanger body and the shuttle valve, the annulus access bore sealable at a substantially flat face; and d) a groove enclosed by a filler, the groove providing communication between a plurality of small annulus access bores and the at least one annulus access bore through the tubing hanger.

* * * * *